US005675211A

United States Patent [19]

Ueda

[11] Patent Number: 5,675,211

[45] Date of Patent: Oct. 7, 1997

[54] COLOR-PICTURE TUBE HAVING A SUPPLEMENTARY ELECTRODE FOR OBTAINING A HIGH RESOLUTION PICTURE

[75] Inventor: Yasuyuki Ueda, Hirakata, Japan

[73] Assignee: Matsushita Electronics Corporation, Osaka, Japan

[21] Appl. No.: 500,576

[22] Filed: Jul. 11, 1995

[30] Foreign Application Priority Data

Jul. 11, 1994 [JP] Japan ..... 6-157749

[51] Int. Cl.[6] ..... H01J 29/51

[52] U.S. Cl. ..... 313/412; 313/414; 313/449; 315/15; 315/382

[58] Field of Search ..... 313/412–415, 313/447, 449, 460; 315/14, 15, 16, 382, 382.1

[56] References Cited

U.S. PATENT DOCUMENTS

| | | | |
|---|---|---|---|
| 4,712,043 | 12/1987 | Takenaka et al. | 313/414 |
| 4,922,166 | 5/1990 | Ichida et al. | 313/412 |
| 4,990,822 | 2/1991 | Guzowski et al. | 313/414 |
| 5,194,778 | 3/1993 | Koh | 313/414 |
| 5,394,054 | 2/1995 | Chen et al. | 313/412 |
| 5,489,814 | 2/1996 | Banury | 313/412 |

FOREIGN PATENT DOCUMENTS

| | | |
|---|---|---|
| 226 145 | 6/1987 | European Pat. Off. . |
| 315269 | 5/1989 | European Pat. Off. . |
| 43 36 532 | 6/1994 | Germany . |
| 56-9946 | 1/1981 | Japan . |
| 58-103752 | 6/1983 | Japan . |
| 4133247 | 5/1992 | Japan . |
| 4-133247 | 5/1992 | Japan . |

*Primary Examiner*—Sandra L. O'Shea
*Assistant Examiner*—J. M. Patidar
*Attorney, Agent, or Firm*—Ratner & Prestia

[57] ABSTRACT

A color-picture tube having a convergence electrode, to which a focusing voltage is applied, a final accelerating electrode, to which an anode voltage is applied, and at least one supplementary electrode placed between the convergence electrode and the final accelerating electrode, to which either (1) a voltage higher than the focusing voltage and lower than the anode voltage is applied or (2) no voltage is applied, resulting in the supplementary electrode being free from a directly applied electric potential, wherein its electric potential is induced by the convergence electrode and the final accelerating electrode. Each of the convergence electrode and the final accelerating electrode is a tube having an elliptical cross section closed with an elliptical end plate having three holes arranged in-line for electron passage. In at least one of the tubes, the end plate is positioned away from the opening of the tube closer to the supplementary electrode. The supplementary electrode is a tube of elliptical cross section arranged coaxially with the convergence electrode and final accelerating electrode. A high resolution picture is obtained without enlarging the bulb neck of the picture tube.

20 Claims, 5 Drawing Sheets

COLOR-PICTURE TUBE HAVING A SUPPLEMENTARY ELECTRODE FOR OBTAINING A HIGH RESOLUTION PICTURE

BACKGROUND OF THE INVENTION

This invention relates generally to a color-picture tube having high resolution over the entire phosphor screen, and in particular, to the structure of the electrodes.

DESCRIPTION OF THE PRIOR ART

The resolution of a color-picture tube depends largely much on the shape and size of the beam spot produced on the phosphor screen.

To obtain high resolution, the electrodes of the tube must have a structure sufficient to produce beam spots which are circular and of small diameter. However, as the beam current increases, the section of the electron beam which passes through the main-lens electric-field of the electron gun becomes larger and the beam spot size becomes larger due to the spherical aberration of the main-lens electric field. Hence, to minimize the influence of the spherical aberration, the aperture has been made as large as possible.

A color-picture tube of the prior art as disclosed in the patent gazettes of Japanese patent application Toku-Ko-Hei 2-18540 or Toku-Kai-Hei 4-133247, as shown in FIG. 7 and FIG. 8, comprises a main lens part consisting of a convergence electrode 1 and an accelerating electrode 2. The convergence electrode 1 comprises a tube 3 with an elliptical cross section and an elliptical end plate 4 closing the tube 3 at opening 3*a*. The end plate 4 is placed at a position away from the opening 3*a*, and has three holes 4*a*, 4*b*, and 4*c* arranged in-line for electron passage. The accelerating electrode 2 comprises a tube 5 with an elliptical cross section and an elliptical end plate 6 closing the tube 5 at opening 5*a*. The end plate 6 is placed at a position away from the opening 5*a*, and has three holes 6*a*, 6*b*, and 6*c* arranged in-line for electron passage. With such a structure, three main-lens electric fields are formed between the three electron-beam-holes 4*a*, 4*b*, and 4*c* and the three electron-beam-holes 6*a*, 6*b*, and 6*c*, and the neighboring two of the three main-lens electric fields partially overlap, to form a main-lens electric field with large apertures. As a result, when the electron beam passes through the main-lens electric field having an increased diameter, the undesirable effect of the spherical aberration can be offset, and the lens magnification may be reduced to produce circular, small beam-spots on the phosphor screen.

The conventional structure of the electrodes, despite its advantage of making the aperture of the main-lens electric-field large, naturally has limitations. If the outer diameters of the convergence electrode and the final accelerating electrode are set to values near the inside diameter of the neck of the glass bulb, the wall electric-field of the neck part intrudes into the main-lens electric field. Also, if the diameter of the neck part becomes large, the deflection sensitivity is lowered.

SUMMARY OF THE INVENTION

It is an object of the present invention to provide a color-picture tube of high resolution which has the main-lens electric field equivalent to a larger diameter device without enlarging the diameter of the glass bulb.

The other objects and advantages of the present invention will be explained in the following detailed description.

To attain the above described objects, a color-picture tube according to the present invention comprises a convergence electrode, to which the focusing voltage is applied, a final accelerating electrode, to which the anode voltage is applied, and at least one supplementary electrode placed between the convergence electrode and the final accelerating electrode, to which a voltage higher than the focusing voltage and lower than the anode voltage is applied, wherein each of said convergence electrode and said final accelerating electrode comprises a tube having an elliptical cross section closed with an elliptical end plate having three holes arranged in-line for electron passage, and in at least one of said tubes, the end plates is positioned away from the opening of said tube closer to said supplementary electrode, and said supplementary electrode comprises a tube having an elliptical cross section arranged coaxially with said convergence electrode and final accelerating electrode.

Another color-picture tube according to the present invention has a convergence electrode, to which the focusing voltage is applied, a final accelerating electrode, to which the anode voltage is applied, and at least one supplementary electrode of free electric potential (not connected to any power source) placed between convergence electrode and the final accelerating electrode, wherein each of said convergence electrode and said final accelerating electrode comprises a tube having an elliptical cross section closed with an elliptical end plate having three holes arranged in-line for electron passage, and in at least one of said tubes, the end plate is positioned away from the opening of said tube closer to said supplementary electrode, and said supplementary electrode comprises a tube having an elliptical cross section arranged coaxially with said convergence electrode and final accelerating electrode.

With the above described structure comprising a convergence electrode, to which the focusing voltage is applied, a final accelerating electrode, to which the anode voltage is applied, and a supplementary electrode of cylindrical form arranged coaxially between them, the domain of the main-lens electric field which is formed between the end plates of said two electrodes is expanded. Further, if the supplementary electrode is supplied with a voltage higher than the focusing voltage and lower than the anode voltage, the electric potential distribution along the axis in the main-lens electric field domain has a moderate slope, and the spherical aberration of the main-lens electric field may be reduced further. Further, undesirable invasion of the wall electric-field of the neck of the glass bulb into the main-lens electric field can be prevented by the shield action of the supplementary electrode.

DETAILED DESCRIPTION OF THE INVENTION

Figure 1:
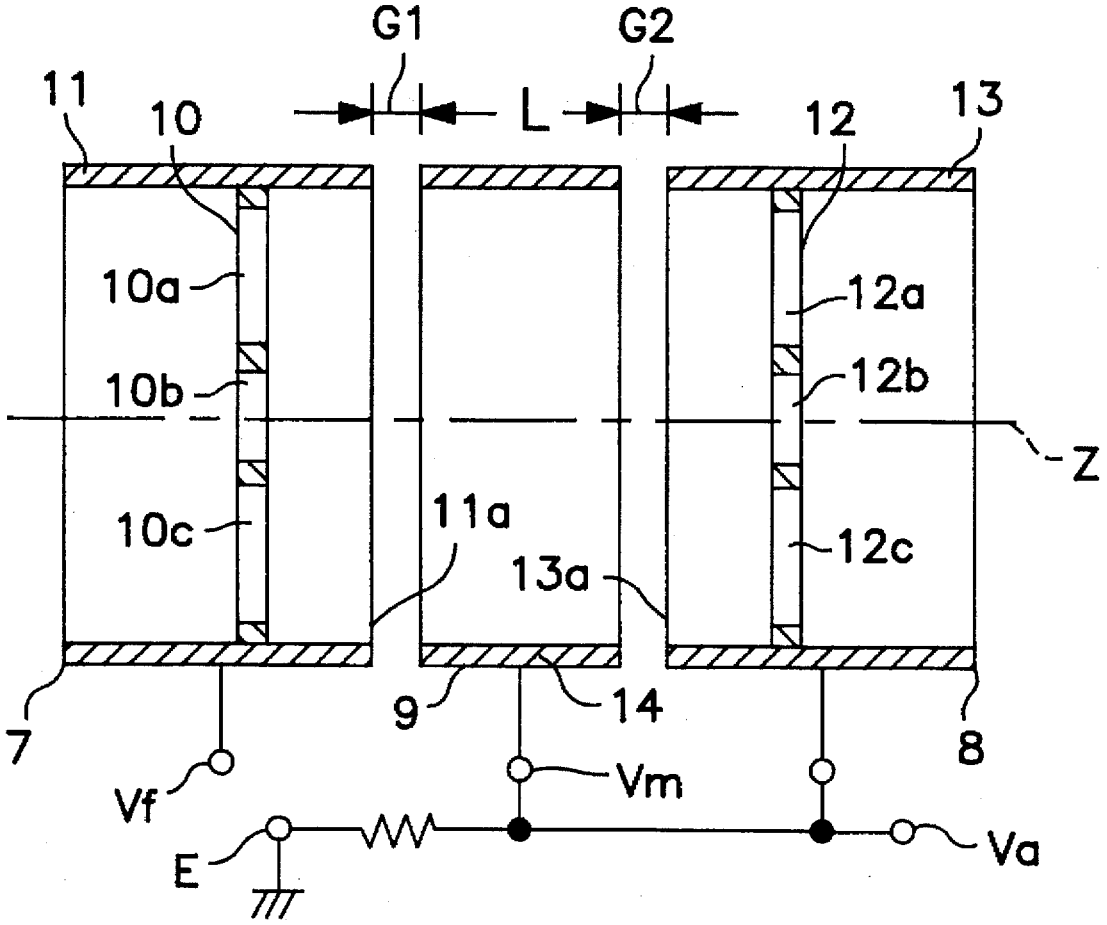
FIG. 1 is a side sectional view of the main-lens part of a color-picture tube embodying the present invention.

Now, referring to the drawings an embodiment of the present invention is explained below.

Referring to FIG. 1, the main lens part of the color-picture tube according to the present invention comprises a convergence electrode 7, a final accelerating electrode 8, and a supplementary electrode 9 positioned between the convergence electrode 7 and the final accelerating electrode 8. The convergence electrode 7 is supplied with the focusing voltage Vf, and the final accelerating electrode 8 is supplied with anode voltage Va. The supplementary electrode 9 is arranged coaxially with the convergence electrode 7 and the final accelerating electrode 8 and is supplied with voltage Vm which is higher than the focusing voltage Vf and is lower than the anode voltage Va.

Figure 2A:
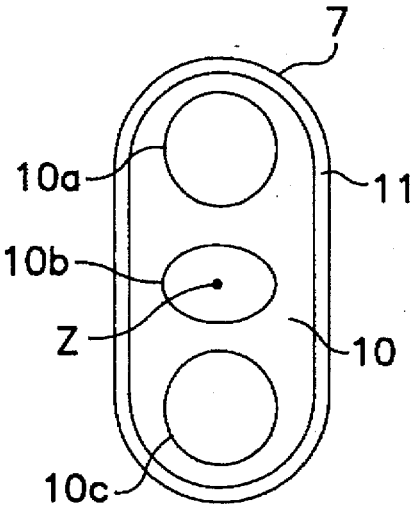
FIGS. 2*a* and 2*b* are front views of the main-lens part of a color-picture tube embodying the present invention.
Figure 2B:
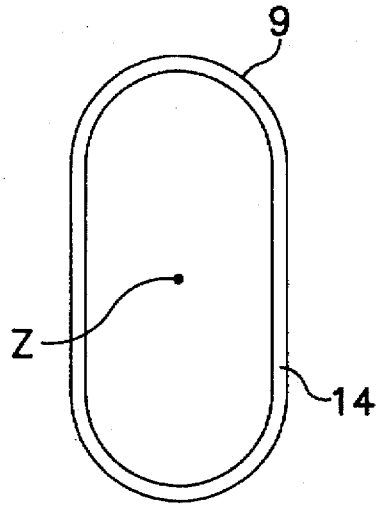

The convergence electrode 7 comprises a tube 11 having an elliptical cross section closed with an elliptical end plate 10, which is placed at a position away from the opening 11*a* of the tube 11 and has three holes 10*a*, 10*b*, and 10*c* arranged in-line for electron beam passage as shown in FIG. 2(*a*). The final accelerating electrode 8, similar to the convergence electrode 7, comprises a tube 13 having an elliptical cross section closed with an elliptical end plate 12, which is placed at a position away from the opening 13*a* of the tube 11 and has three holes arranged in-line 12*a*, 12*b*, and 12*c* for electron beam passage. The supplementary electrode 9 comprises a tube 14 having an elliptical cross section but has no end plate as show in FIG. 2(*b*).

Figure 3:
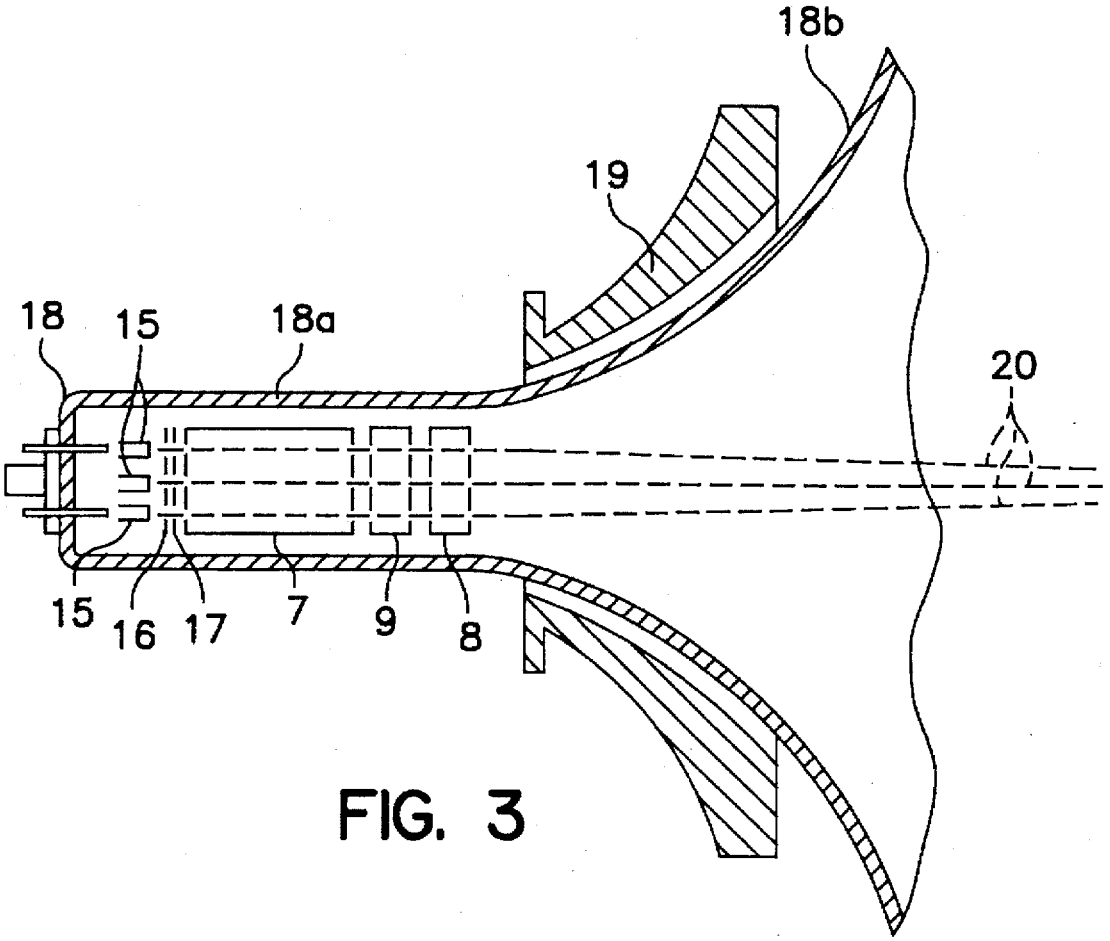
FIG. 3 is a side sectional view of the main part of a color-picture tube embodying the present invention.

As shown in FIG. 3, the main lens part comprising the convergence electrode 7, final accelerating electrode 8 and the supplementary electrode 9, together with three cathodes 15, three control electrodes 16, and an accelerating electrode 17 all arranged in-line, forms the electron gun, and the gun is enclosed within the neck 18*a* of a glass bulb 18 which is the envelope of the color-picture tube. The color-picture tube 18 has a funnel 18*b*, and is provided, at the outside of the funnel 18*b* near the neck 18*a*, with a deflection yoke 19 to generate a deflection magnetic field, by which the three electron beams 20 emitted from the electron guns are deflected to fall on the fluorescent screen (not shown in the figure).

In the color-picture tube according to the present invention, the distance between the convergence electrode 7 and the final accelerating electrode 8 is larger than that of the conventional structure. The supplementary electrode 9 is provided with an arbitrary voltage higher than the focus voltage Vf but lower than the anode voltage Va, so that the electric potential gradient along the z-axis between the convergence electrode 7 and the final accelerating electrode 8 is smaller than that of the conventional structure. Consequently, the effective opening of the main-lens electric field becomes larger, and both the spherical aberration and the lens magnification are lowered. Also, since the wall electric-field and the main-lens electric field are shielded by the supplementary electrode 9, the unfavorable effect of the wall electric-field on the electron beam, etc. can be prevented.

Figure 4:
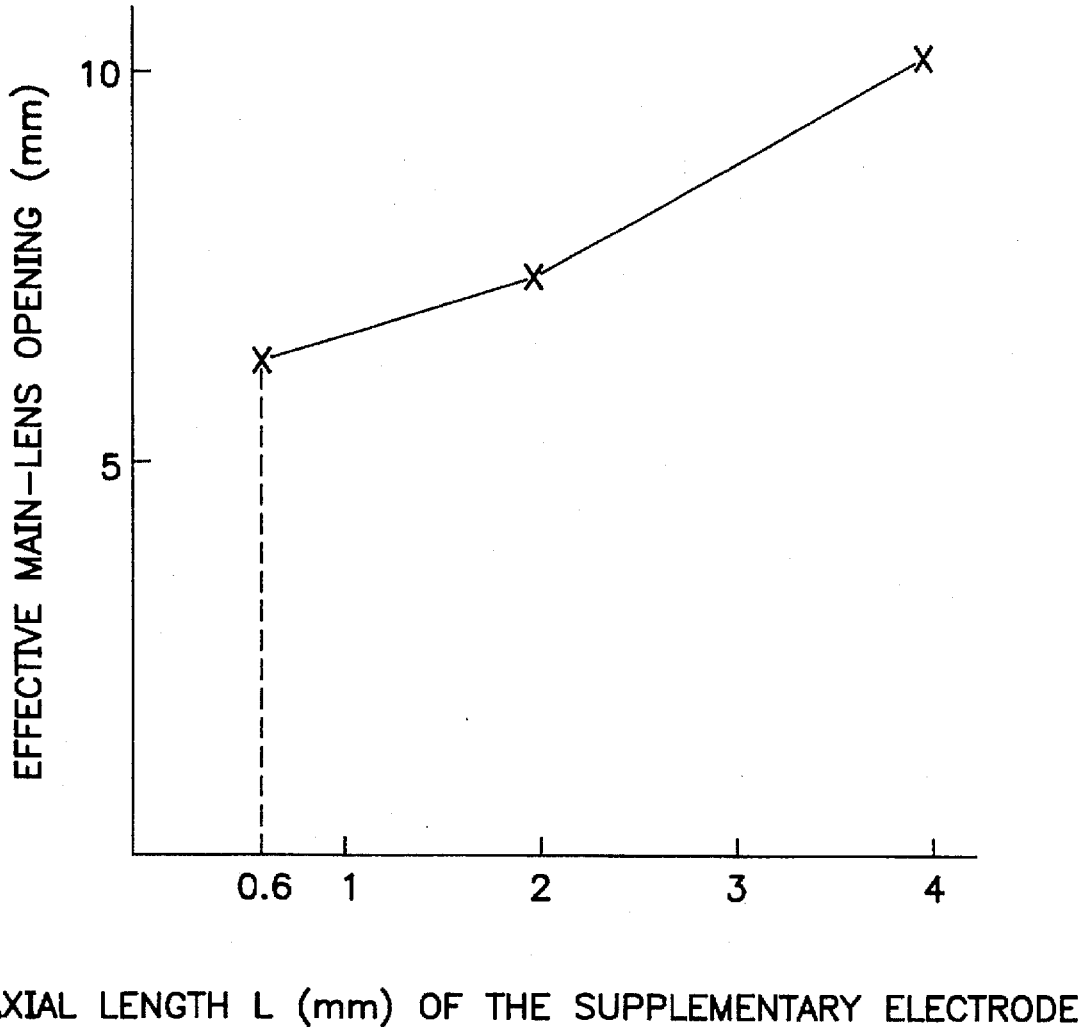
FIG. 4 is a graph showing the relationship between the main-lens aperture and the axial length of the supplementary electrode.

FIG. 4 illustrates the variation of the effective main-lens opening against the variation of the axial length L of the supplementary electrode, for axial lengths L of 0.6 mm, 2 mm, and 4 mm, while the inner diameter of the glass bulb neck 18*a* is 17.5 mm, the distance G1 between the convergence electrode 7 and the supplementary electrode 9 is 0.8 mm, the distance G2 between the supplementary electrode 9 and the final accelerating electrode 8 is 0.8 mm, and Va, Vm, and Vf being set at 25 kV, 16 kV, and 7 kV, respectively. All the axial lengths L result in an effective main-lens aperture larger than that of the prior art electrodes (5.5 mm).

Figure 5:
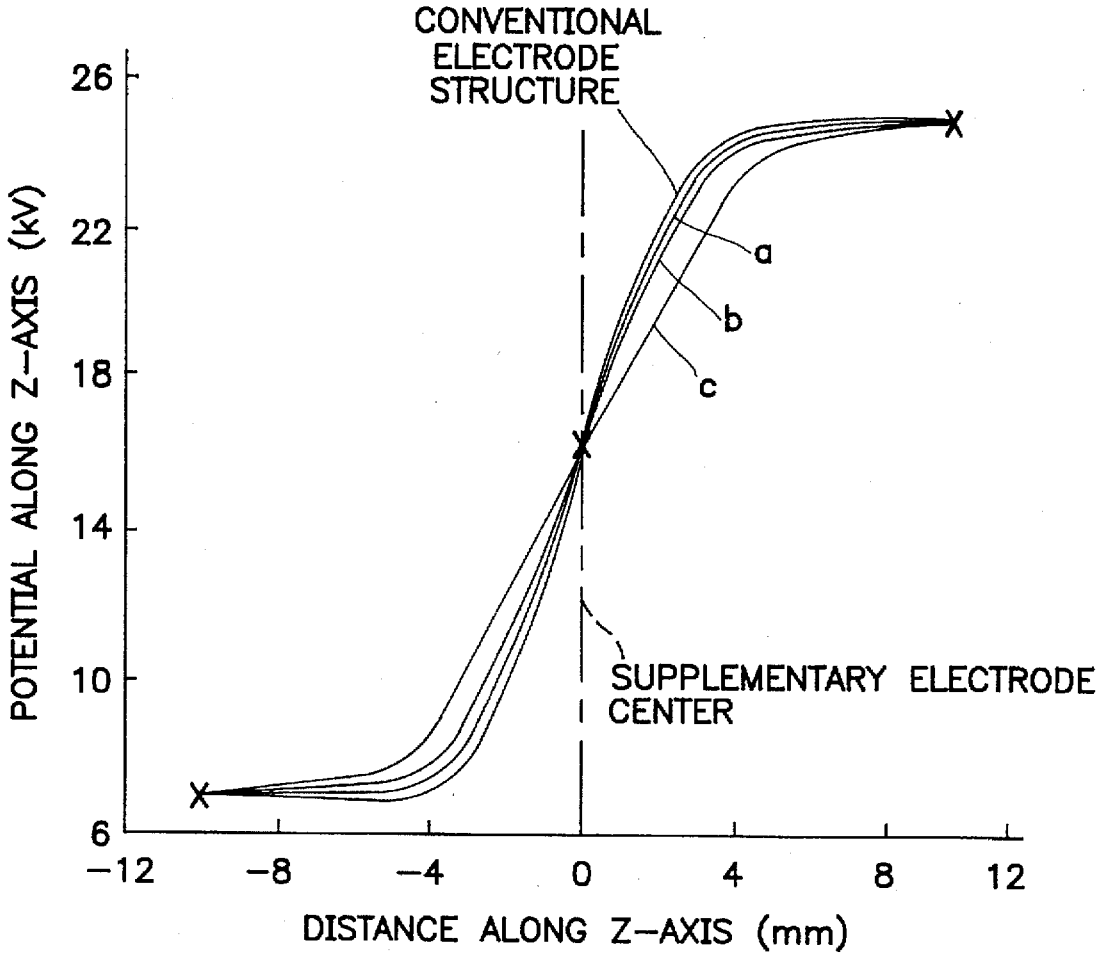
FIG. 5 is a graph illustrating the electric potential distribution along the axis of the main-lens part.

In FIG. 5, the potential distributions along the z-axis are shown, where curves a, b, and c refer to the supplementary electrode length L equal to 0.8 mm, 2 mm, and 4 mm, respectively. Compared with that of the conventional electrode structure, the potential gradient becomes less steep as L becomes larger, resulting in the enlarging of the effective main-lens-opening.

In the picture tube of the present invention, the supplementary electrode 9 is a tube 14 which has no end plate, resulting in the enlargement of the lens-electric-field forming domain common to the three main-lens electric fields. Hence, the potential distribution along the z-axis has a smoother gradient than that of the conventional structure and the effective main-lens opening can be enlarged. Also, the invasion of the wall electric-field on the neck 18a of the glass bulb 18 into the main-lens electric field domain is prevented by the shielding provided by the supplementary electrode 9.

Figure 6:
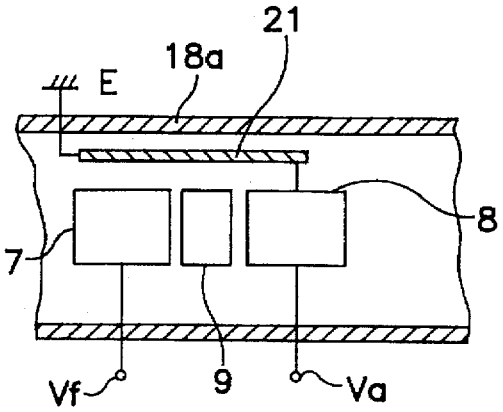
FIG. 6 is a side sectional view showing a voltage source coupled to the supplementary electrode.
Figure 7:
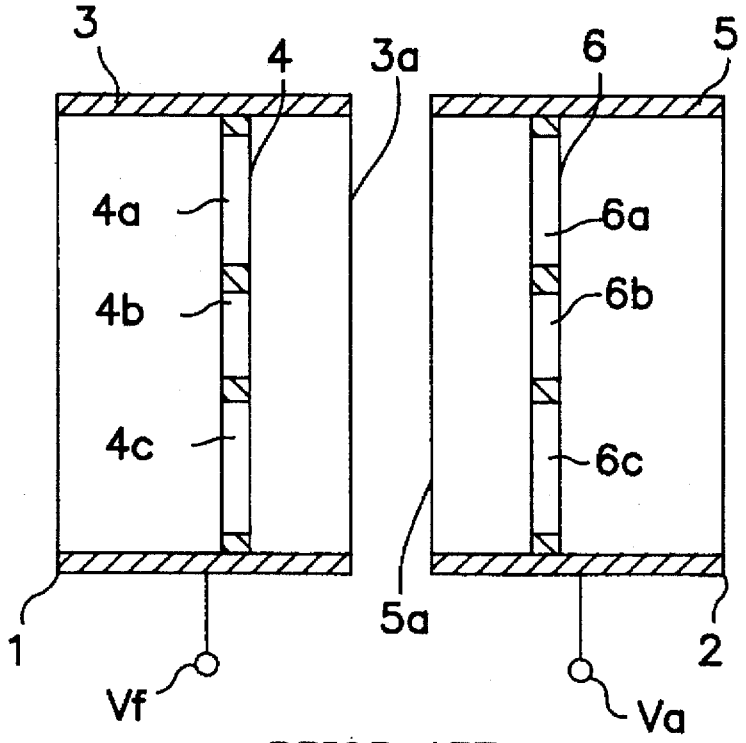
PRIOR ART FIG. 7
FIG. 7 is a side sectional view of the main-lens part of a color-picture tube of the prior art.
Figure 8:
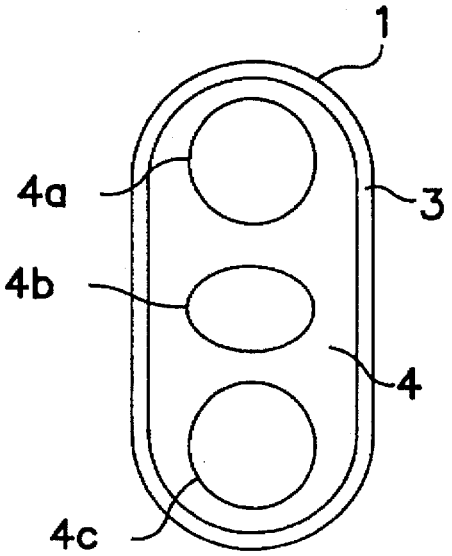
FIG. 8 PRIOR ART
FIG. 8 is a front view of the main-lens part of a color-picture tube of the prior art.

Referring to FIG. 6, the supplementary electrode 9 is provided with a resistor 21 which applies to the supplementary electrode a voltage Vm higher than the focus voltage Vf and lower than the anode voltage Va.

One end of the resistor 21 is connected with the power source of the anode voltage Va, and the other end with the ground E, and the voltage Vm is obtained from a middle tap of resistor 21. The resistor 21 may be formed as a film on a glass rod which supports the electron gun electrodes or as a film on the inside wall of the neck 18*a* of the bulb 18. The resistor 21 is not limited to a linear form, but may be non-linear or spiral shaped.

The supplementary electrode 9 may not be connected with the power source, but kept unpowered. The supplementary electrode 9 not connected to the power source is shown in FIG. 6 by the 'X' through the connector between the supplementary electrode 9 and the resistor 21. In this case, the supplementary electrode 9, which is placed between the convergence electrode 7 with focusing voltage Vf and the accelerating electrode 8 with anode voltage Va, is provided with a voltage induced by both the electrodes 7 and 8.

Further, the supplementary electrode 9 may be constructed from several tubes. Also, whereas, in the above embodiment, the end plate 10 of the convergence electrode 7 and the end plate 12 of the final accelerating electrode 8 were both placed at the positions away from the openings 11*a* and 13*a* of the tubes 11 and 13, only one of the end plates may be placed away from the opening. The three holes for electron passage arranged in-line in the end plates 10 and 12 are not confined to be circular as shown in the figures, but may all be elliptical or a similar shape, or the outside two holes may be circular and the central hole elliptical, or any combination of shapes.

Thus, according to the present invention, three main-lens electric fields are formed so that adjacent fields overlap. A supplementary electrode placed between the convergence electrode and the final accelerating electrode causes the electric potential distribution along the axis of the main-lens to have a moderate slope. As a result, the effective opening of the main-lens is enlarged and the spherical aberration and the lens magnification are both reduced, so that, the radius of the beam spot can be made smaller, realizing high resolution over the phosphor screen.

What is claimed:

1. A color-picture tube comprising:

a convergence electrode, to which a focusing voltage is applied, a final accelerating electrode, to which an anode voltage is applied, and at least one supplementary electrode to which a voltage higher than the focusing voltage and lower than the anode voltage is applied, said supplementary electrode placed between said convergence electrode and said final accelerating electrode and arranged coaxially with said convergence electrode and said final accelerating electrode so that said supplementary electrode forms a lens-electric-field which is common to three main-lens electric fields formed between said convergence electrode and said final accelerating electrode, wherein, each of said convergence electrode, said supplementary electrode and said final accelerating electrode comprises a tube having an elliptical cross section, and each of the tube of said convergence electrode and the tube of said final accelerating electrode has an elliptical end plate having three holes arranged in-line for electron passage, and in at least one of the tube of said convergence electrode and the tube of said final accelerating electrode, said end plate is positioned away from the opening of said tube closer to said supplementary electrode.

2. A color-picture tube of claim 1, wherein an effective main-lens opening is enlarged by an increase of an axial length of said supplementary electrode.

3. A color-picture tube of claim 2, wherein an opening diameter of each of said convergence electrode, said supplementary electrode and the final accelerating electrode, respectively, are nearly identical.

4. A color-picture tube of claim 3, wherein the axial length of said supplementary electrode is between 0.6 mm and 4 mm.

5. A color-picture tube of claim 4, wherein a center hole of said three holes arranged in-line for electron passage is elliptical and the other two holes are nearly circular, and a first area of the center hole is smaller than at least one of a second area and a third area the other two holes of said three holes.

6. A color-picture tube of claim 3, wherein a center hole of said three holes arranged in-line for electron passage is elliptical and the other two holes are nearly circular, and a first area of the center hole is smaller than at least one of a second area and a third area the other two holes of said three holes.

7. A color-picture tube of claim 1, wherein an opening diameter of each of said convergence electrode, said supplementary electrode and the final accelerating electrode, respectively, are nearly identical.

8. A color-picture tube of claim 1, wherein a center hole of said three holes arranged in-line for electron passage is elliptical and the other two holes are nearly circular, and a first area of the center hole is smaller than at least one of a second area and a third area the other two holes of said three holes.

9. A color-picture tube of claim 1, wherein said color picture tube has a neck and said voltage applied to said supplementary electrode is set at a predetermined value to suppress a wall electric field formed in said neck.

10. A color-picture tube of claim 1, wherein said three main-lens electric fields are formed by said convergence electrode said supplementary electrode and said accelerating electrode so that adjacent fields overlap.

11. A color-picture tube comprising:

a convergence electrode, to which a focusing voltage is applied, a final accelerating electrode, to which an anode voltage is applied, and at least one supplementary electrode having an electric potential responsive to said convergence electrode and said final accelerating electrode, said supplementary electrode placed between said convergence electrode and said final accelerating electrode and arranged coaxially with said convergence electrode and said final accelerating electrode so that said supplementary electrode forms a lens-electric-field which is common to three main-lens electric fields formed between said convergence electrode and said final accelerating electrode, wherein, each of said convergence electrode, said supplementary electrode and said final accelerating electrode comprises a tube having an elliptical cross section, and each of the tube of said convergence electrode and the tube of said final accelerating electrode has an elliptical end plate having three holes arranged in-line for electron passage, and in at least one of the tube of said convergence electrode and the tube of said final accelerating electrode, said end plate is positioned away from the opening of said tube closer to said supplementary electrode.

12. A color-picture tube of claim 11, wherein an effective main-lens opening is enlarged by an increase of an axial length of said supplementary electrode.

13. A color-picture tube of claim 12, wherein an opening diameter of each of said convergence electrode, said supplementary electrode and the final accelerating electrode, respectively, are nearly identical.

14. A color-picture tube of claim 13, wherein the axial length of said supplementary electrode is between 0.6 mm and 4 mm.

15. A color-picture tube of claim 14, wherein a center hole of said three holes arranged in-line for electron passage is elliptical and the other two holes are nearly circular, and a first area of the center hole is smaller than at least one of a second area and a third area the other two holes of said three holes.

16. A color-picture tube of claim 13, wherein a center hole of said three holes arranged in-line for electron passage is elliptical and the other two holes are nearly circular, and a first area of the center hole is smaller than at least one of a second area and a third area the other two holes of said three holes.

17. A color-picture robe of claim 11, wherein an opening diameter of each of said convergence electrode, said supplementary electrode and the final accelerating electrode, respectively, are nearly identical.

18. A color-picture tube of claim 11, wherein a center hole of said three holes arranged in-line for electron passage is elliptical and the other two holes are nearly circular, and a first area of the center hole is smaller than at least one of a second area and a third area the other two holes of said three holes.

19. A color-picture tube of claim 11, wherein said color picture tube has a neck and said electric potential of said supplementary electrode is set at a predetermined value to suppress a wall electric field formed in said neck.

20. A color-picture tube of claim 11, wherein said three main-lens electric fields are formed by said convergence electrode said supplementary electrode and said accelerating electrode so that adjacent fields overlap.

* * * * *